US007970292B2

(12) United States Patent
Kim et al.

(10) Patent No.: US 7,970,292 B2
(45) Date of Patent: Jun. 28, 2011

(54) CONSUMABLE UNIT AND IMAGE FORMING APPARATUS INCLUDING MEMORY STORING CONSUMABLE ITEM INFORMATION

(75) Inventors: Yong-geun Kim, Suwon-si (KR); Hae-seog Jo, Yongin-si (KR); Ho-ill Hyun, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 734 days.

(21) Appl. No.: 11/972,893

(22) Filed: Jan. 11, 2008

(65) Prior Publication Data

US 2008/0273883 A1 Nov. 6, 2008

(30) Foreign Application Priority Data

May 4, 2007 (KR) ..... 10-2007-0043476

(51) Int. Cl.
*G03G 15/00* (2006.01)
*G03G 15/08* (2006.01)

(52) U.S. Cl. ..... 399/12; 399/24; 399/26; 399/27; 399/109

(58) Field of Classification Search ..... 399/12, 399/13, 24, 25, 26, 27, 109
See application file for complete search history.

(56) References Cited

U.S. PATENT DOCUMENTS 6,738,903 B1 * 5/2004 Haines ..... 399/12
7,295,787 B2 * 11/2007 Kikuchi ..... 399/12
7,333,738 B2 * 2/2008 Nasu ..... 399/12

* cited by examiner

*Primary Examiner* — William J Royer
(74) *Attorney, Agent, or Firm* — Staas & Halsey LLP

(57) ABSTRACT

A consumable unit and an image forming apparatus for controlling a consumable includes a first memory that stores consumable item information regarding the consumable and provides the consumable item information through password authentication, and a second memory that rewrites recycling prevention information, which indicates that recycling is impossible, a limited number of times. Therefore, if the consumable is replaced, it is possible to prevent the first memory and second memory from being recycled.

21 Claims, 6 Drawing Sheets

FIG. 3A

| | | | | |
|---|---|---|---|---|
| 00h | PLACE OF SALE | MANUFACTURER'S LOGO | MANUFACTURER'S NAME | 19h |
| 20h | SERIAL NUMBER | PRINTED PAGE COUNT | VERIFICATION INFORMATION | 39h |
| 40h | REMAINING TONER INFORMATION | TONER EXHAUSTION INFORMATION | | 59h |
| | | | | |

FIG. 3B

| | | | | |
|---|---|---|---|---|
| 00h | PLACE OF SALE | MANUFACTURER'S LOGO | MANUFACTURER'S NAME | 19h |
| 20h | SERIAL NUMBER | PRINTED PAGE COUNT | VERIFICATION INFORMATION | 39h |
| 40h | REMAINING TONER INFORMATION | TONER EXHAUSTION INFORMATION | RECYCLING PREVENTION INFORMATION | 59h |
| | | | | |

CONSUMABLE UNIT AND IMAGE FORMING APPARATUS INCLUDING MEMORY STORING CONSUMABLE ITEM INFORMATION

CROSS-REFERENCE TO RELATED APPLICATION

This application claims the benefit of Korean Application No. 2007-43476, filed May 4, 2007, in the Korean Intellectual Property Office, the disclosure of which is incorporated herein by reference.

BACKGROUND OF THE INVENTION

1. Field of the Invention

Aspects of the present invention relate to a consumable unit and an image forming apparatus for controlling the consumable unit. More particularly, aspects of the present invention relate to a consumable unit having a non-recyclable memory and an image forming apparatus for controlling the consumable unit.

2. Description of the Related Art

Image forming apparatuses, such as facsimile machines, printers, copiers, or multi-function machines embodying the functions of the above-mentioned devices in a single device, provide printing functions. In order to perform printing, consumable units such as toner, photosensitive drums, developing devices or other units are required.

Consumable units need to be periodically or non-periodically replaced with new replacement units, because consumable units have a limited lifespan. Consumable units may have memories that store various types of information to maintain and manage the consumable units.

An image forming apparatus determines whether a consumable unit mounted on the image forming apparatus is genuine or not, based on the information stored in the memory of the mounted consumable unit. Additionally, the image forming apparatus continues to monitor the information stored in the memory of the consumable unit, to remind a user when it is time to replace the consumable units with a new consumable unit, or to control the image forming apparatus not to operate when the consumable unit is exhausted.

If a particular consumable unit is found to be exhausted, a user should replace the consumable unit with a new product. However, because of relatively higher costs of genuine products, users may be tempted to use low-priced non-genuine consumable units that are recycled from expired consumable units. Because conventional consumable units typically use electrically erasable programmable read only memories (EEPROMs) to store identification information and recycling information, it is not difficult for an ill-intentioned user to alter or duplicate the information stored in the memories so as to fool image forming apparatuses into accepting counterfeit or recycled consumables as genuine products.

Therefore, a conventional image forming apparatus may have difficulty in determining whether a recyclable consumable unit is genuine, or not, since the recyclable consumable unit may have memory information duplicated from a genuine consumable unit. The reuse of non-genuine memories may cause serious problems for the image forming apparatus and further reduce the lifespan of the image forming apparatus.

SUMMARY OF THE INVENTION

Aspects of the present invention relate to provide a consumable unit and an image forming apparatus for controlling the consumable unit, in which recycling a memory in which information on a consumable is recorded, when there is a need to replace the consumable unit with a new product, is not allowed.

According to an aspect of the present invention, there is provided a consumable unit including a first memory to store consumable item information on a consumable; and a second memory to rewrite recycling prevention information, which indicates that recycling is not allowed, a predetermined, limited number of times.

According to aspects of the present invention, the second memory may include an area to back up the consumable item information stored in the first memory.

According to aspects of the present invention, the consumable unit may further include a third memory to back up the consumable item information stored in the first memory.

According to aspects of the present invention, the consumable item information may include data regarding the place of sale, the name of the manufacturer, and the serial number of the consumable.

According to another aspect of the present invention, there is provided an image forming apparatus that controls a consumable, the apparatus including a consumable unit including a first memory to store and provide consumable item information on a consumable used in forming images; and a second memory to rewrite recycling prevention information, which indicates when recycling is not allowed, a predetermined, limited number of times; and a controller to extract the consumable item information and the recycling prevention information from the first memory and the second memory, respectively, and to control the use of the consumable.

According to aspects of the present invention, if the time comes to replace the consumable, the controller may write in the second memory recycling prevention information indicating that recycling of the second memory is not allowed.

According to aspects of the present invention, the controller may initialize the recycling prevention information written in the second memory and use the second memory the predetermined, limited number of times.

According to aspects of the present invention, the second memory may include an area to back up the consumable item information stored in the first memory. The controller may back up the consumable item information stored and updated in the first memory to the second memory.

According to aspects of the present invention, the image forming apparatus may further include a third memory to back up the consumable item information stored in the first memory. The controller may back up the consumable item information stored and updated in the first memory to the third memory.

According to aspects of the present invention, the controller may determine whether the first memory is genuine according to whether the controller can verify the verification information of the first memory. The verification information may be a password, and the controller may verify whether the first memory is genuine according to whether the controller can authenticate the password.

According to aspects of the present invention, if it is determined that the recycling prevention information has been rewritten the predetermined, limited number of times, the controller may determine that the second memory is not genuine, or may determine a time at which the second memory needs to be replaced.

According to aspects of the present invention, the consumable item information stored in the first memory may include information that is updated every time printing is performed.

According to aspects of the present invention, the image forming apparatus may further include a display, and if the controller determines, based on consumable item information, that a print quality may be reduced, the controller may process a message notifying that the print quality may be reduced, together with a message instructing a user to replace the consumable, to be displayed on the display.

According to aspects of the present invention, if the remaining toner level reaches a set threshold, the controller may write information indicating that the amount of toner remaining is not sufficient as exhaustion information for the consumable, and may direct that a message instructing a user to replace the consumable be displayed on the display.

According to aspects of the present invention, if the remaining toner level reaches a top limit indicating that toner has been completely exhausted, the controller may write the recycling prevention information to the second memory.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which:

FIG. 3A shows a map of a first memory shown in FIG. 2;

FIG. 3B shows a map of a second memory shown in FIG. 2;

DETAILED DESCRIPTION OF THE EMBODIMENTS

Figure 1:
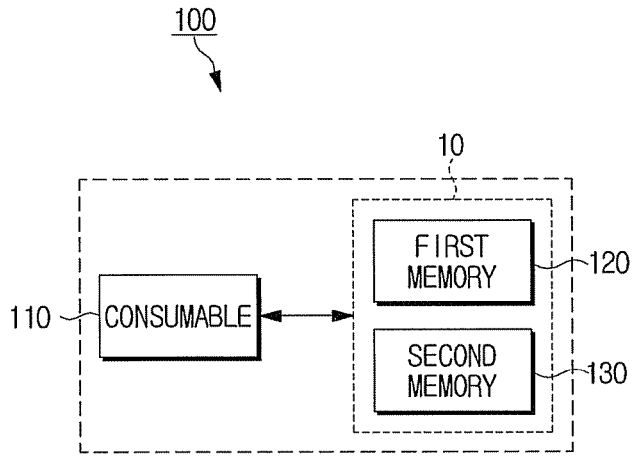
FIG. 1 is a block diagram schematically showing a consumable unit according to an embodiment of the present invention.

Reference will now be made in detail to the present embodiments of the present invention, examples of which are illustrated in the accompanying drawings, wherein like reference numerals refer to like elements throughout. The embodiments are described below in order to explain the present invention by referring to the figures.

FIG. 1 is a block diagram schematically showing a consumable unit according to an embodiment of the present invention. In FIG. 1, a consumable unit 100 according to an embodiment of the present invention includes a consumable 110 (that is, the part or material that wears out or becomes depleted during use), a first memory 120 and a second memory 130. While the consumable unit 100 is described herein as providing a consumable for an image forming apparatus, it is to be understood that the consumable unit 100 according to aspects of the present invention may be used with other apparatuses and systems having consumable parts or components. The consumable may be a single part or material or may be a combination of parts and materials, such as a toner cartridge.

The consumable unit 100 needs to be replaced when its lifespan expires. In an image forming apparatus using a consumable 110, the consumable unit 100 can be attached to and detached from the image forming apparatus. If the consumable unit 100 is not replaced at the appropriate time, it is difficult for the consumable unit 100 to provide functions required by the image forming apparatus and the image forming apparatus may be damaged. The appropriate time for replacing or refilling the consumable unit 110 may be determined by the passage of a pre-set period of time or by a pre-set amount of use.

The first memory 120 stores and updates consumable item information on the consumable 110. The consumable item information may include the place of sale, the name of the manufacturer, the serial number and verification information of the consumable 110 or the consumable unit 100, and exhaustion information for the consumable 110.

The first memory 120 may include a secret memory that is coded and manufactured in order to prevent the first memory 120 from being recycled in the image forming apparatus (not shown in FIG. 1). The secret memory determines that the first memory 120 is genuine through password authentication, and provides the stored consumable item information. In other words, if the consumable unit 100 is mounted in the image forming apparatus, the image forming apparatus may decode the password stored in the first memory 120 and perform password authentication. When the password authentication process is successful, the consumable unit 100 may be used to perform required processes using the stored consumable item information.

Alternatively, if password authentication fails, the image forming apparatus may determine that the consumable unit 100 is a non-genuine product, and may instruct the user to replace the consumable unit 100 with a genuine product.

When the time comes to replace the consumable 110, the second memory 130 may rewrite recycling prevention information, which indicates that it is impossible to recycle the second memory 130, a limited number of times. If a consumable unit 100 is not to be recycled, the second memory 130 may include a one-time programmable (OTP) memory capable of writing the recycling prevention information only once. Then, when the time comes to replace the consumable 110, the recycling prevention information may be rewritten in the second memory 130 and may not be initialized thereafter, which thus makes reuse of the second memory 130 impossible.

If it is intended that a consumable 110 may be recycled a predetermined limited number of times (the predetermined number of times being referred to hereinafter as "n"), the second memory 130 may include a memory that is designed so that the recycling prevention information is rewritten n number of times. When the time comes to replace the consumable 110, the written recycling prevention information may be initialized an n number of times. Accordingly, a user may recycle the second memory 130, and as a result, may reuse the second memory 130 and may recycle the consumable 110 an n number of times. Data regarding the value of n and the number of times that the recycling prevention information is rewritten is stored in an area of the second memory 130 other than the area in which the recycling prevention information is rewritten, or in the image forming apparatus.

The written recycling prevention information may be initialized by user authentication, but the present invention is not limited thereto.

Additionally, the second memory 130 may include an area that backs up the consumable item information stored in the first memory 120, so that if the consumable item information stored in the first memory 120 is deleted or if it is impossible to reuse the first memory 120, then the consumable item information stored in the second memory 130 may be used in the image forming apparatus.

The consumable unit 100 may further include a third memory (not shown) to store the consumable item information stored in the first memory 120. The first and second memories 120 and 130 may be implemented in a single chip on a printed circuit board (PCB) 10, but the present invention is not limited to such a configuration.

Figure 2:
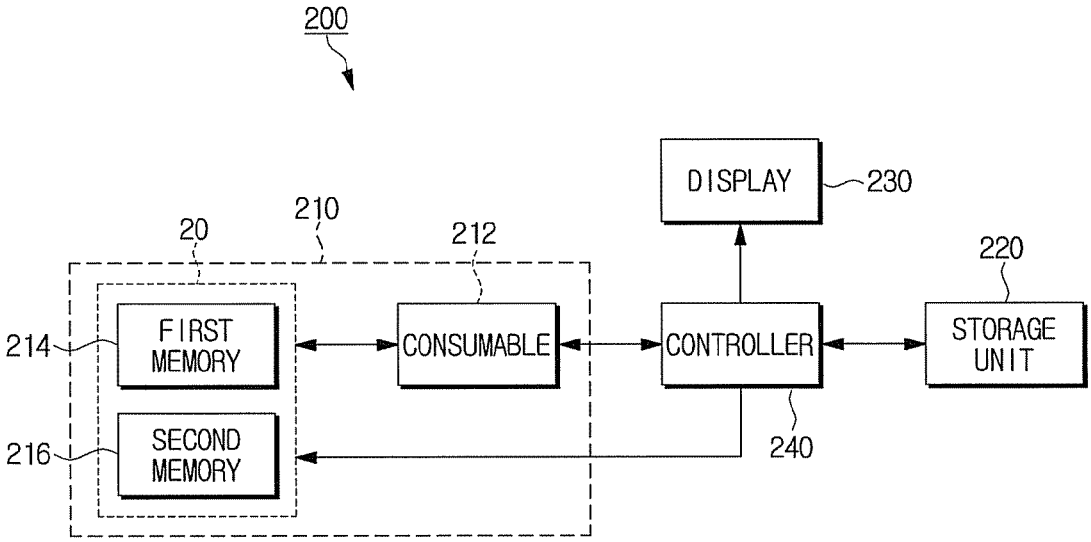
FIG. 2 is a block diagram showing an image forming apparatus including a consumable unit, according to an embodiment of the present invention.

FIG. 2 is a block diagram showing an image forming apparatus for controlling a consumable unit, according to an embodiment of the present invention. The image forming apparatus 200 performs printing processes, such as electrifying, exposing, developing, transferring and fixing and includes a main memory, a print engine for image forming, and an interface that communicates with a computer and/or a network, or other units. The above units are known to persons skilled in the art, so illustrations and descriptions thereof are not repeated.

As shown in FIG. 2, the image forming apparatus 200 includes a consumable unit 210, a storage unit 220, a display 230 and a controller 240. The consumable unit 210 includes a consumable 212, a first memory 214 and a second memory 216. Since the consumable unit 210 of FIG. 2 has similar characteristics to the consumable unit 110 of FIG. 1, a description of overlapping features is not repeated. The consumable 212 is a part or a material that is worn out or consumed during image forming processes performed by the image forming apparatus 200. The consumable 212 may comprise a bottle containing toner to express colors of an image, or an organic photoconductive (OPC) drum, a developing roller, a charging roller, a transferring roller, a fixing roller, a supplying roller and a pressing roller to perform electrifying, exposing, developing, transferring and fixing operations. The consumable 212 may comprise a combination of a bottle and at least one of the above-described OPC drum and rollers, such as, for example, a cartridge. Hereinafter, an example in which the consumable unit 210 is a unit that provides toner in the image forming apparatus 200 will be described.

The consumable unit 210 can be attached to and detached from the image forming apparatus 200, and needs to be replaced when a preset time limit expires or when the consumable has been consumed. The image forming apparatus 200 requires the timely replacement of consumable unit 210 in order to obtain clear prints and to prevent damage to the image forming apparatus 200.

The first memory 214 stores and updates consumable item information regarding the consumable 212. Additionally, the first memory 214 provides the consumable item information by password authentication in order to prevent recycling of the first memory 214. In other words, a password is recorded in the first memory 214 by a password algorithm, so that the image forming apparatus 200 can determine whether the first memory 214 is genuine or not.

When authentication is performed by decoding the password recorded in the first memory 214, the image forming apparatus 200 determines that the first memory 214 is genuine and performs printing using the consumable item information stored in the first memory 214. If the image forming apparatus 200 fails to decode the password even after trying a set number of times, the image forming apparatus 200 may determine that the first memory 214 is a non-genuine product.

The second memory 216 includes an area in which recycling prevention information is rewritten a predetermined limited number of times to prevent recycling of the second memory 216 beyond the predetermined limited number of times. If the second memory 216 is an OTP memory, the recycling prevention information may be written in the second memory 216 only once. For example, if the value of the recycling prevention information is set to "1" in the second memory 216, which indicates that it is impossible to recycle the second memory 216, the controller 240 may determine that it is impossible to reuse the second memory 216.

When the consumable 212 is completely used up, a user may be tempted to use a non-genuine consumable such as a specific color toner. However, a user is required to use a consumable unit 210 having a genuine first memory 214 and a genuine second memory 216, because of the password protection and information on the remaining toner level in the first memory 214, and the recycling prevention information set in the second memory 216. A detailed description of a control method of the consumable unit 210 will be given in detail with reference to FIGS. 6 and 7.

The second memory 216 may include an area that backs up the consumable item information stored in the first memory 214, so that if the consumable item information stored in the first memory 214 is deleted or if it is impossible to reuse the first memory 214, the controller 240 may use consumable item information stored in the second memory 216. The area for backing up the consumable item information may have EEPROM characteristics.

The consumable item information stored in the first memory 214 may also be backed up in a third memory (not shown). In this case, the third memory may be mounted on the same substrate as the first and second memories 214 and 216, or may be mounted in the image forming apparatus 200.

FIG. 3A shows an example of a map of the first memory 214 according to the embodiment of FIG. 2, and FIG. 3B shows an example of a map of the second memory 216 according to the embodiment of FIG. 2.

As shown in FIG. 3A, in order to store various types of consumable item information, the first memory 214 includes areas to store information on the place of sale, the name of the manufacturer, the logo of the manufacturer and the serial number of the consumable 212 or the consumable unit 210, verification information, such as a password, which allows for a determination on whether the first memory 214 is genuine or not, and the printed page count, remaining toner level and toner exhaustion information.

The controller 240 updates the printed page count, the remaining toner level and the toner exhaustion information in the areas for recording the printed page count, toner usage and toner exhaustion information, respectively, as the above information is continuously modified during a printing operation.

The term "printed page count" refers to the total number of pages of print output from the image forming apparatus 200. The term "remaining toner level refers to the amount of toner that has been used and thus, the amount of toner currently remaining in the toner bottle. The remaining toner level may be set to increase every time toner is used, but the present invention is not limited to such a configuration.

For example, the remaining toner level may be represented by a scale that runs between "0" and "110", wherein level "0" indicates that 100% of the toner remains, and level "100" indicates that most of the toner has been used, such that an insufficient amount of toner is available to be used to perform normal quality printing. The level "100" may be used as a reference to determine when it is necessary to switch to a low-quality printing mode in order to conserve toner. Level "110" may be used to indicate the point at which the toner is completely consumed so that even printing in a low-quality mode is no longer possible, at which time the consumable unit 210 or the consumable 212 needs to be replaced due to a lack of toner. In other words, in the scale system described herein for the remaining toner level, a higher number on the scale indicates that there is less remaining toner in the consumable unit 210. It is to be understood that other scale systems may be used, such as numerical scale in which "100" indicates that 100% of the toner remains and "0" indicates that no toner remains, or a color scale in which different colors represent different amount of remaining toner.

If the remaining toner level is equal to or less than level "100", the toner exhaustion information may be set to a value of "0", that is, the toner exhaustion information has not been set, which indicates that sufficient toner is still available to be used. If the remaining toner level reaches level "100", the toner exhaustion information may be set to a value of "1", which indicates that the toner supply is nearly exhausted. Additionally, if the remaining toner level reaches level "110", the recycling prevention information may be set to a value of "1", indicating that the consumable unit 210 needs to be replaced at once with a new one due to the toner supply having been completely exhausted.

Referring to FIG. 3B, the second memory 216 includes an area to write the consumable item information stored in the first memory 214, and an area to write the recycling prevention information. As described above, when the time comes to replace the consumable 212, the recycling prevention information prevents recycling of the second memory 216, either after a first usage period, or after a predetermined number of refills, and ensures that a genuine product is used. If the continuously updated data is updated in the first memory 214, the controller 240 may rewrite the continuously updated data being updated in the first memory 214 to the second memory 216, and if the remaining toner level reaches level "110", the controller 240 may set the value of the recycling prevention information to "1". Accordingly, the consumable unit 210 needs to be replaced with a new consumable unit.

Referring back to FIG. 2, the storage unit 220 stores a reference value required to set or alter the consumable item information, a reference value required to determine the time at which the consumable unit 210 needs to be replaced, and an algorithm required to decode the password of the first memory 214. Specifically, the storage unit 220 may store a remaining toner level of "100" as a reference value required to set the toner exhaustion information in the consumable item information to a value of "1", and a remaining toner level of "110" as a reference value required to set the recycling prevention information to a value of "1". Therefore, when the toner exhaustion information is set to a value of "1", the toner supply is nearly exhausted, and when the recycling prevention information is set to a value of "1", the toner supply is completely exhausted.

The controller 240 controls the entire operation of the image forming apparatus 200 using a control program. In particular, if the image forming apparatus 200 is in a warming-up state, such as a print standby mode, or if a print request is input, the controller 240 may extract the consumable item information from the first memory 214, may extract the recycling prevention information from the second memory 216, and may then control the use of the consumable 212.

More specifically, the controller 240 decodes the password recorded in the first memory 214 and performs authentication of the first memory 214. If authentication is successful by decoding the password, the controller 240 may determine that the first memory 214 is genuine. Conversely, if the controller 240 fails to decode the password even after trying a set number of times, the controller 240 may determine that the first memory 214 is not genuine.

In addition, if the recycling prevention information is set to a value of "1" in the second memory 216 and has been rewritten a predetermined number of times, this may indicate that the consumable 212 has been completely exhausted, and the controller 240 may determine that the consumable 212 and the second memory 216 need to be replaced due to a lack of the consumable 212, or this may indicate that the second memory 216 is not genuine. Data regarding the number of times that the recycling prevention information has been rewritten is stored in the second memory 216 or the main memory (not shown), and may be updated by the controller 240 every time the recycling prevention information is rewritten.

Accordingly, if a user replaces only the consumable 212 such as toner with a new product and tries to reuse the consumable unit 210 with the original first and second memories 214 and 216, the controller 240 may recognize that the first and second memories 214 and 216 are non-genuine products which cannot be used. Therefore, in order to continue using the image forming apparatus, the user needs to replace the used first and second memories 214 and 216 with new, genuine first and second memories 214 and 216. In this situation, the genuine products may be manufactured by the same manufacturer as the image forming apparatus 200, or by a manufacturer authorized by the manufacturer of the image forming apparatus 200. As used herein, the term "non-genuine" refers both to counterfeit products and to products that contain first and second memories 214 and 216 that are inappropriately recycled. Similarly, the term "genuine" refers to new products that are manufactured or authorized by the manufacturer or to recycled products that have not been recycled more than a predetermined number of times.

The controller 240 counts the number of pages printed every time printing is performed, and stores the number of printed pages in the area for storing the printed page count in the first memory 214. Additionally, the controller 240 checks the amount of toner remaining, and stores the remaining toner level in the area for storing the remaining toner level.

If the remaining toner level reaches level "100" as a reference value, the controller 240 may set the value of the toner exhaustion information, for example "1", in the area for recording the toner exhaustion information in the first memory 214, and may store level "100" as the remaining toner level in the area for storing the remaining toner level in the first memory 214, because the toner supply is nearly exhausted. Additionally, the controller 240 may direct that a message instructing a user to replace the consumable unit 210, together with a message notifying that the print quality may be reduced, can be generated and displayed on the display 230 to let a user know that the amount of toner remaining is not sufficient for normal printing and that the print quality cannot be guaranteed.

Additionally, if the remaining toner level reaches level "110" as a reference value, the controller 240 may store level "110" as the remaining toner level in the area for storing the remaining toner level in the first memory 214, and may set the value of the recycling prevention information, as, for example, "1", in the area for recording the recycling prevention information in the second memory 216. The controller 240 may direct that a message notifying that printing is impossible, together with message instructing a user to replace the consumable unit 210, can be generated and displayed on the display 230.

As described above, the controller 240 sets the values of the exhaustion information of the consumable and the recycling prevention information in the first memory 214 or the second memory 216 according to the remaining toner level, and determines whether the first and second memories 214 and 216 are genuine or not, using the exhaustion information of the consumable and the recycling prevention information set in the first and second memories 214 and 216. Furthermore, if it is determined that the first and second memories 214 and 216 are not genuine, the controller 240 may block the first memory 214 or the second memory 216 from being used, and thereby prevent printing operations from being performed.

Figure 4:
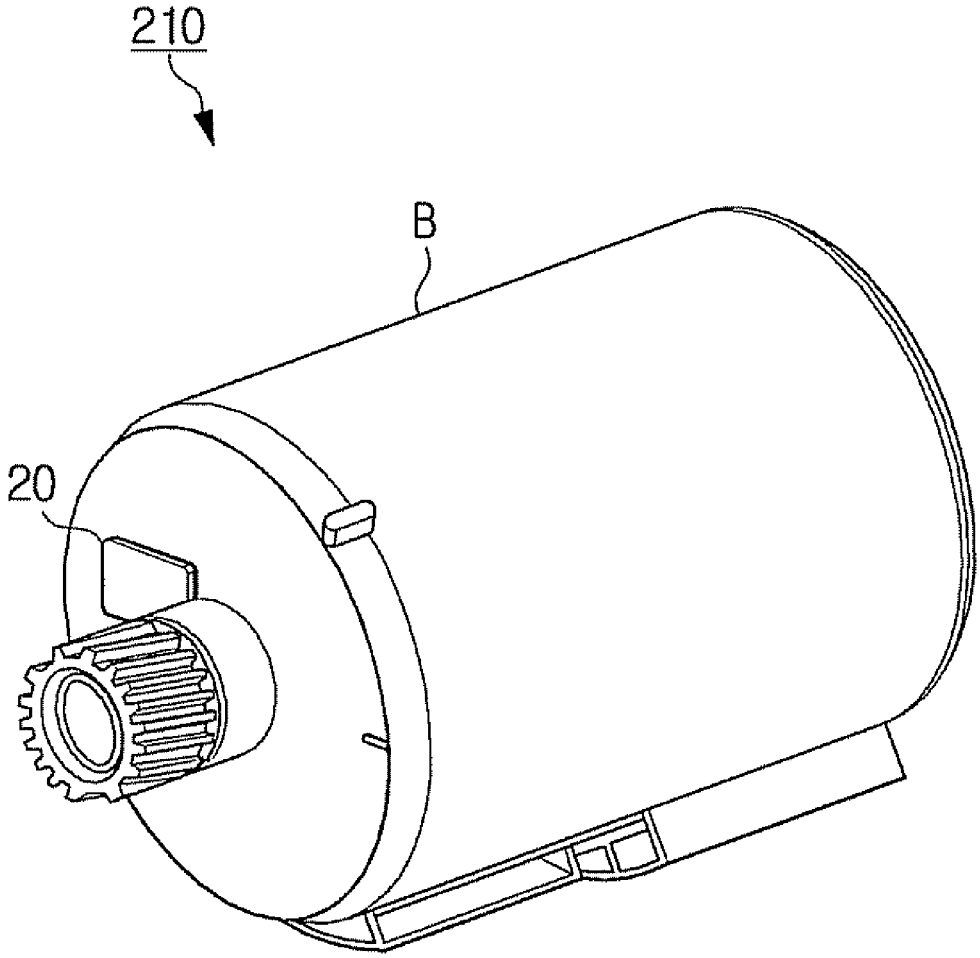
FIG. 4 is a perspective view of a consumable unit, which includes a memory unit and a bottle for containing toner.

FIG. 4 is a perspective view of a consumable unit that includes a memory unit and a bottle containing toner. When the image forming apparatus 200 performs black-and-white printing, the consumable unit 210 includes a bottle B containing black toner, and a PCB 20 which is mounted on a side of the bottle B and includes the first and second memories 214 and 216. If the toner of the bottle B is exhausted, a user may use a consumable produced by a different manufacturer from the manufacturer of the image forming apparatus 200, but may be required to use genuine first and second memories 214 and 216, which are manufactured by the same manufacturer as the image forming apparatus 200.

Figure 5:
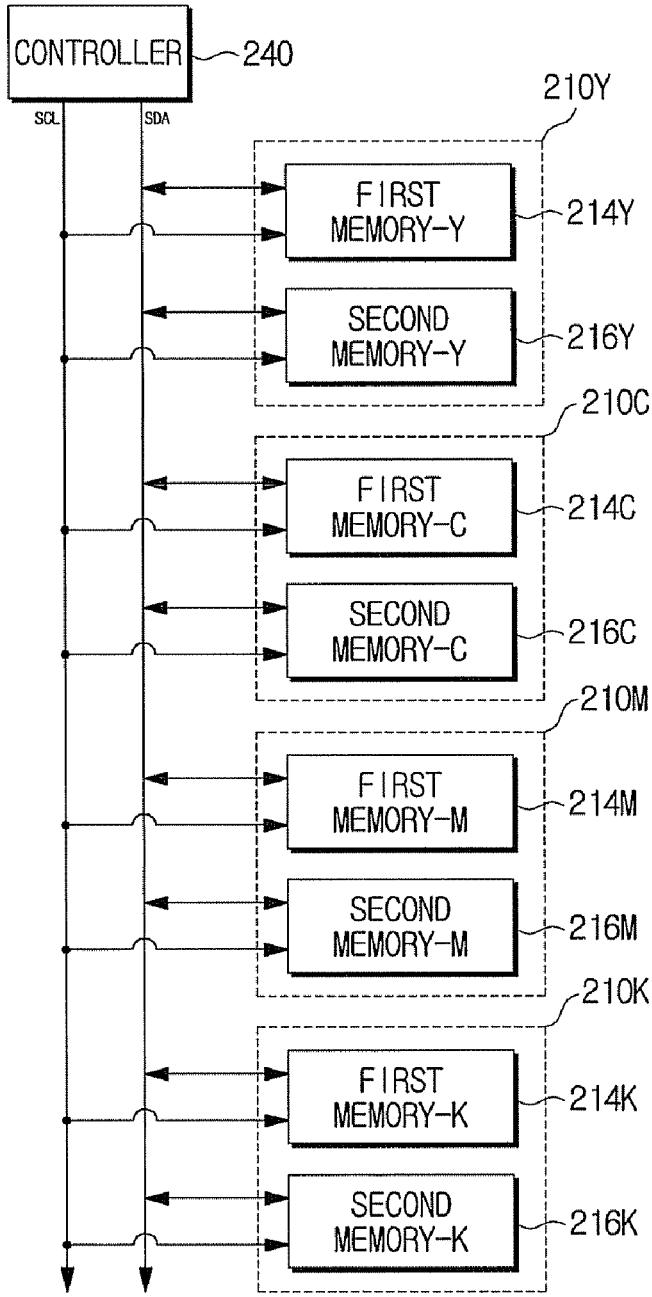
FIG. 5 is a block diagram schematically showing an image forming apparatus including consumable units for each color, when the image forming apparatus performs color printing.

FIG. 5 is a block diagram schematically showing an image forming apparatus including consumable units for each color when the image forming apparatus performs color printing. In FIG. 5, the image forming apparatus 200 includes first to fourth consumable units 210Y, 210M, 210C and 210K, and a controller 240. The first to fourth consumable units 210Y, 210M, 210C and 210K of FIG. 5 have the same characteristics as the consumable unit 210 of FIG. 2, and first memories 214Y, 214C, 214M and 214K, and second memories 216Y, 216C, 216M and 216K of FIG. 5 are similar to the first memory 214 and the second memory 216 of FIG. 2, so a description of overlapping features is not repeated.

However, the first to fourth consumable units 210Y, 210M, 210C and 210K are divided according to color. In other words, the first to fourth consumable units 210Y, 210M, 210C and 210K contain yellow, cyan, magenta and black toner, respectively. The first memories 214Y, 214C, 214M and 214K and the second memories 216Y, 216C, 216M and 216K each store consumable item information pertaining to their respective color toner and recycling prevention information.

Figure 6:
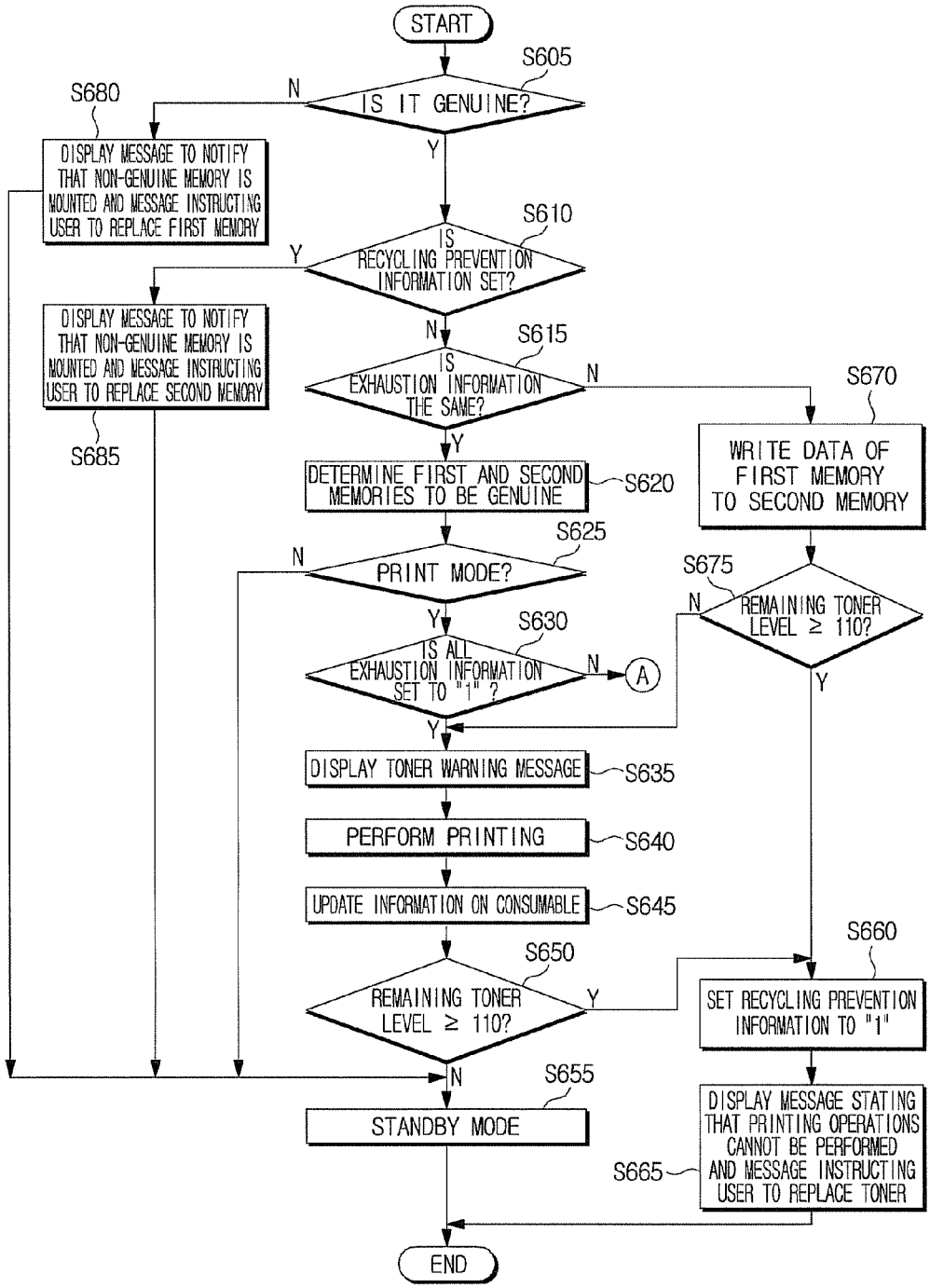
FIG. 6 is a flowchart showing a control method of a consumable unit of the image forming apparatus shown in FIG. 2.

FIG. 6 is a flowchart depicting a control method of a consumable unit of the image forming apparatus shown in FIG. 2. As shown in FIG. 6, if the image forming apparatus 200 is in a warming-up state, such as a print standby mode, or if a print request is input, the controller 240 may determine whether the first memory 214 of the consumable unit 210 is genuine or not in operation S605. Specifically, the controller 240 may check the verification information being stored in the area that records the verification information in the first memory 214, and may provisionally determine the first memory 214 to be a genuine product. If the prestored password is decoded using an algorithm, the controller 240 may determine that the first memory 214 is genuine.

A user may try to fool the controller by providing a non-genuine first memory that tries to decode the password. However, the controller 240 may be set up to allow only a limited number of attempts to decode the password. If the correct password is not provided within a set number of attempts, the controller 240 may determine in operation S605 that the first memory 214 is not genuine and may prevent further attempts to decode the password. Next, in operation S680, the controller 240 may direct that a message notifying that a non-genuine memory is mounted and message instructing a user to replace the first memory 214 with a genuine product be generated and displayed on the display 230.

If the controller 240 determines in operation S605 that the first memory 214 is genuine, the controller 240 may check in operation S610 whether or not the recycling prevention information is set in the second memory 216. For example, if information in the area that records the recycling prevention information is set to "0", the controller 240 may determine that the recycling prevention information has not been set.

If it is determined that the recycling prevention information has not been set, the controller 240 may detect in operation S615 whether or not the toner exhaustion information set in the first memory 214 is the same as that in the second memory 216.

If it is detected that the first and second memories 214 and 216 contain the same toner exhaustion information, the controller 240 may determine in operation S620 that both the first and second memories 214 and 216 are genuine. If print mode is determined in operation S625, the controller proceeds with operation S630.

If the toner exhaustion information detected in operation S615 is set to a value of "1" in a print mode, the controller 240 may cause a toner warning message to be generated and displayed on the display 230 in operation S635. The toner warning message may include information notifying that the amount of toner remaining is not sufficient to perform normal printing and that the print quality may be decreased.

The controller 240 may control the print engine (not shown) so that data to be printed can be printed on paper in operation S640. In this operation S640, the controller 240 may also count the number of pages printed every time printing is performed.

If operation S640 is performed, the controller 240 may update the consumable item information generated during printing in the first memory 214, and may back up information updated in the first memory 214 to the second memory 216 in operation S645. In other words, the controller 240 may add the number of printed pages counted in operation S640 to the number of printed pages prestored in the area that stores the printed page count in the first memory 214, to update the total number of printed pages in the area that stores the printed page count. Additionally, the controller 240 may check the level of currently remaining toner to update the remaining toner level in the area that records the remaining toner level.

The controller 240 may determine in operation S650 whether the remaining toner level updated in the first memory 214 or the second memory 216 reaches level "110".

If it is determined that the remaining toner level is less than level "110", that is, if there is still enough toner left to perform low quality printing, the controller 240 may enter a standby mode in operation S655 while continuing to display the toner warning message.

Alternatively, if it is determined in operation S650 that the remaining toner level is at a level equal to or greater than level 110, that is, if the toner supply is completely exhausted and printing, even at a low quality, is impossible, the controller 240 may set the recycling prevention information in the area that stores the recycling prevention information on the second memory 216 in operation S660. In other words, the controller 240 may set the value of the recycling prevention information to "1" in the area that stores the recycling prevention information, indicating that the toner supply has been completely exhausted and printing is impossible.

The controller 240 may subsequently direct that a message stating that printing operations cannot be performed and a message instructing a user to replace toner can be generated and displayed on the display 230 in operation S665. The message stating that printing operations cannot be performed informs a user that printing is impossible due to the lack of toner, and the message instructing a user to replace toner notifies the user that replacement of the toner is required in order to perform printing.

If it is detected in operation S615 that the toner exhaustion information in the first memory 214 and the toner exhaustion information in the second memory 216 differ from each other, the controller 240 may write the consumable item information written in the first memory 214 to the second memory 216 in operation S670. This is because a value of "0" is set in the area where the toner exhaustion information is written in the first memory 214 and a value of "1" is set in the area where the toner exhaustion information is written in the second memory 216, so the controller 240 determines that the first memory 214 is a memory generated by recycling a previously used memory and that the second memory 216 has not been recycled in such a manner.

After operation S670, if it is detected that the remaining toner level recorded in the first memory 214 is less than level "110" in operation S675, the controller 240 may perform operations S635 to S655 again.

If the recycling prevention information is set in the second memory 216 in operation S610, that is, if a value of "1" is set in the area that records the recycling prevention information, the controller 240 may determine that the second memory 216 is not genuine, and may direct that a message notifying that a non-genuine memory is mounted and a message instructing a user to replace the second memory 216 with a genuine product, be generated and displayed on the display 230 in operation S685.

Figure 7:
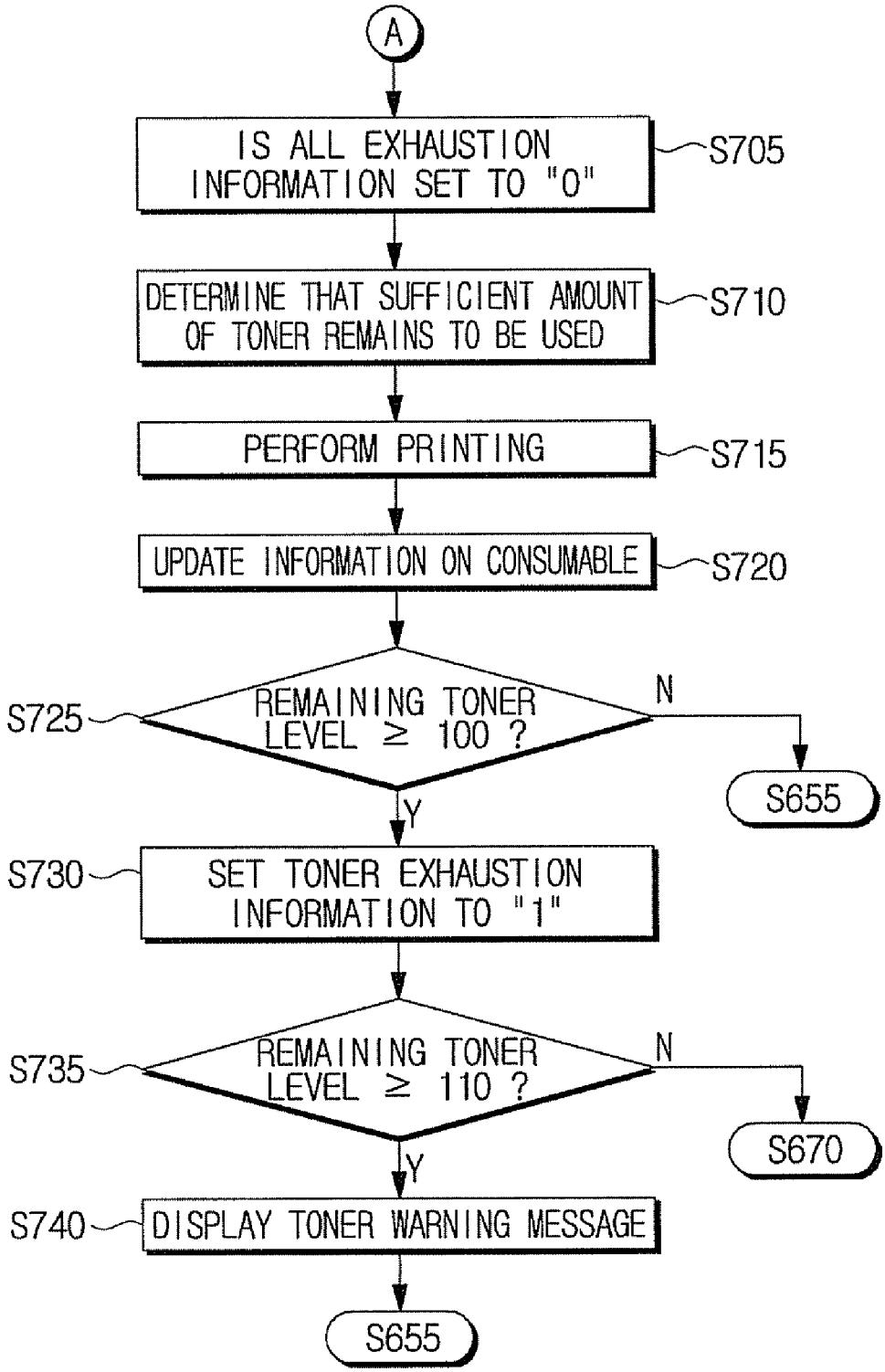
FIG. 7 is a branch of the flowchart of FIG. 6 showing aspects of the control method when the toner exhaustion information is set to a value of "0" in operation S630 of FIG. 6.

FIG. 7 is branch of the flowchart of FIG. 6 showing an aspect of the control method in which the toner exhaustion information in all areas in which the toner exhaustion information is stored is set to a value of "0" in operation S630 of FIG. 6.

If it is determined in operation S630 of FIG. 6 that the toner exhaustion information in all areas in which the toner exhaustion information is stored is set to a value of "0", the controller 240 may determine in operations S705 and S710 that a sufficient amount of toner remains to be used. In operation S715, the controller 240 may control the print engine (not shown) to perform printing. The controller 240 may also count the number of pages printed every time printing is performed.

After printing is completed, the controller 240 in operation S720 may update the consumable item information generated during printing in the first memory 214, and may back up the information updated in the first memory 214 to the second memory 216. In other words, the controller 240 may add the number of pages printed and counted in operation S715 to the number of printed pages pre-stored in the area of the first memory 214 that records the printed page count, to update the total number of printed pages recorded in the area that records the printed page count. Additionally, the controller 240 may check the level of toner remaining to update the remaining toner level in the area for recording the remaining toner level.

The controller 240 may determine in operation S725 whether the remaining toner level updated in the first memory 214 or the second memory 216 reaches level "100". If it is determined that the remaining toner level is equal to or greater than level "100", the controller 240 may set the toner exhaustion information in the first memory 214 and second memory 216 to a value of "1" in operation S730, indicating that the toner supply has been completely exhausted and that printing operations cannot be performed.

After operation S730, the controller 240 may determine in operation S735 whether the remaining toner level updated in the first memory 214 or the second memory 216 at operation S720 reaches level "110".

If it is determined that the remaining toner level is less than level "110" in operation S735, the controller 240 may direct that a toner warning message be generated and displayed on the display 230 in operation S740. The toner warning message may include information notifying that the amount of toner remaining is not sufficient for normal quality printing and that the print quality may be reduced.

Alternatively, if it is determined that the remaining toner level is equal to or greater than level "110" in operation S735, the controller 240 may set the recycling prevention information of the second memory 216 to a value of "1" in operation S670, indicating that the toner supply has been completely exhausted and that printing operations cannot be performed. Next, the controller 240 may direct that a message stating that printing operations cannot be performed and a "message instructing a user to replace toner, be generated and displayed on the display 230 in operation S740.

In the situation described above, toner is the consumable 212 of the consumable unit 210, but the present invention is not limited thereto. For example, if a photosensitive drum is the consumable 212 of the consumable unit 210, the controller 240 may determine that the lifespan of the photosensitive drum (not shown) has expired when the number of pages printed reaches a predetermined number. In other words, if the total number of pages printed reaches a reference value used to determine the time at which the photosensitive drum needs to be replaced, the controller 240 may set exhaustion information for the photosensitive drum to a value of "1" and may display the message instructing a user to replace the consumable unit 210 on the display 230.

A consumable unit according to an embodiment of the present invention includes a consumable, a first memory, and a second memory.

The first memory may store consumable item information on the consumable.

The second memory may rewrite recycling prevention information, which indicates when recycling is not allowed, a limited number of times.

According to an embodiment of the present invention, a method of controlling a consumable unit providing toner in an image forming apparatus will be explained in detail.

The consumable unit to include toner may provide a first memory, and a second memory.

The first memory may store toner information. The toner information may include verification information on whether the first memory is genuine, a printed page count, a remaining toner level and toner exhaustion information.

The second memory may rewrite recycling prevention information, which indicates when recycling is not allowed, a predetermined, limited number of times and to back up the toner information of the first memory.

When a print request is received by the image forming apparatus, a provisional determination may be made as to whether the first memory is genuine by verifying the verification information.

If the provisional determination determines that the first memory is not genuine, a first warning message may be displayed, and the image forming apparatus may be returned to a standby mode without performing printing.

If the provisional determination determines that the first memory is genuine, it may be determined whether recycling prevention information is set in the second memory.

If the recycling prevention information is set in the second memory, a second warning message may be displayed, and the image forming apparatus may be returned to a standby mode without performing printing.

If the recycling prevention information is not set in the second memory, it may be determined whether the first memory and the second memory contain the same toner exhaustion information.

If the first memory and the second memory contain the same toner exhaustion information, it may be determined that the first and second memories are genuine.

If the first memory and the second memory do not contain the same toner exhaustion information, toner information of the first memory may be written to the second memory, and it may be determined whether toner is completely exhausted.

If the toner is completely exhausted, recycling prevention information may be set to indicate that the toner is completely exhausted, and a third warning message may be displayed.

If the toner is not completely exhausted, printing may be performed.

As described above, in the consumable unit and the image forming apparatus for controlling the consumable according to the exemplary embodiments of the present invention, the consumable unit includes a first memory and a second memory mounted therein, and information to prevent a recycling of the first memory is set in the OTP memory when the time comes to replace the consumable unit, while information regarding the time to replace the consumable unit is updated in the second memory. Accordingly, restoration of data stored in the first memory and second memory is prevented, and as a result, recycling of the first memory and second memory is prevented.

Furthermore, use of a recycled consumable and/or an inferior, non-authorized consumable, which may seriously affect the lifespan of the image forming apparatus, may be prevented in advance by preventing the recycling of a memory.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A consumable unit comprising:

a first memory to store consumable item information on a consumable; and a second memory to rewrite recycling prevention information, which indicates when recycling is not allowed, a limited number of times, wherein the first memory is a secret memory that is coded and manufactured in order to prevent the first memory from being recycled in an image forming apparatus.

2. The consumable unit according to claim 1, wherein the consumable item information further comprises data regarding the place of sale, name of the manufacturer, and serial number of the consumable.

3. A consumable unit comprising:

a first memory to store consumable item information on a consumable; and a second memory to rewrite recycling prevention information, which indicates when recycling is not allowed, a limited number of times, wherein the second memory includes an area to back up the consumable item information stored in the first memory.

4. A consumable unit comprising:

a first memory to store consumable item information on a consumable;

a second memory to rewrite recycling prevention information, which indicates when recycling is not allowed, a limited number of times; and a third memory to back up the consumable item information stored in the first memory.

5. An image forming apparatus that controls a consumable, the apparatus comprising:

a consumable unit comprising:

a first memory to store and provide consumable item information on a consumable used in forming images; and a second memory to rewrite recycling prevention information, which indicates when recycling is not allowed, a limited number of times; and a controller to extract the consumable item information and the recycling prevention information from the first memory and the second memory, respectively, and to control the use of the consumable, wherein the first memory is a secret memory that is coded and manufactured in order to prevent the first memory from being recycled in an image forming apparatus.

6. The apparatus according to claim 5, wherein, if the time comes to replace the consumable, the controller writes in the second memory recycling prevention information indicating that recycling of the second memory is not allowed.

7. The apparatus according to claim 5, wherein the controller initializes the recycling prevention information written in the second memory and uses the second memory the predetermined, limited number of times.

8. The apparatus according to claim 5, wherein the second memory comprises a one-time programmable (OTP) memory that writes the recycling prevention information only once.

9. The apparatus according to claim 5, wherein the first memory and the second memory include verification information that is used to determine whether the consumable is genuine.

10. The apparatus according to claim 5, wherein, if determined that the recycling prevention information has been rewritten the limited number of times, the controller determines that the second memory is not genuine, or determines a time at which the second memory needs to be replaced.

11. The apparatus according to claim 5, wherein the consumable is one of a color toner and a photosensitive drum, or is an assembly, comprising at least one of the color toner and photosensitive drum, used in forming images.

12. An image forming apparatus that controls a consumable, the apparatus comprising:

a consumable unit comprising:

a first memory to store and provide consumable item information on a consumable used in forming images, and a second memory to rewrite recycling prevention information, which indicates when recycling is not allowed, a limited number of times; and a controller to extract the consumable item information and the recycling prevention information from the first memory and the second memory, respectively, and to control the use of the consumable, wherein the second memory comprises an area to back up the consumable item information stored in the first memory; and the controller backs up the consumable item information stored and updated in the first memory to the second memory.

13. An image forming apparatus that controls a consumable, the apparatus comprising:

a consumable unit comprising:

a first memory to store and provide consumable item information on a consumable used in forming images, and a second memory to rewrite recycling prevention information, which indicates when recycling is not allowed, a limited number of times;

a controller to extract the consumable item information and the recycling prevention information from the first memory and the second memory, respectively, and to control the use of the consumable; and a third memory to back up the consumable item information stored in the first memory, wherein the controller backs up the consumable item information stored and updated in the first memory to the third memory.

14. An image forming apparatus that controls a consumable, the apparatus comprising:

a consumable unit comprising:

a first memory to store and provide consumable item information on a consumable used in forming images, and a second memory to rewrite recycling prevention information, which indicates when recycling is not allowed, a limited number of times; and a controller to extract the consumable item information and the recycling prevention information from the first memory and the second memory, respectively, and to control the use of the consumable, wherein the first memory and the second memory include verification information that is used to determine whether the consumable is genuine, and wherein, the controller determines whether the first memory is genuine according to whether the controller can verify the verification information of the first memory.

15. The apparatus according to claim 14, wherein the verification information is a password and the controller determines whether the first memory is genuine according to whether the controller can authenticate the password.

16. An image forming apparatus that controls a consumable, the apparatus comprising:

a consumable unit comprising:

a first memory to store and provide consumable item information on a consumable used in forming images, and a second memory to rewrite recycling prevention information, which indicates when recycling is not allowed, a limited number of times; and a controller to extract the consumable item information and the recycling prevention information from the first memory and the second memory, respectively, and to control the use of the consumable, wherein the consumable item information stored in the first memory comprises information that is updated every time printing is performed.

17. The apparatus according to claim 16, further comprising a display, wherein, if the controller determines, based on the updated consumable item information, that a print quality may be reduced, the controller processes a message notifying that the print quality may be reduced, together with message instructing a user to replace the consumable, to be displayed on the display.

18. An image forming apparatus that controls a consumable, the apparatus comprising:

a consumable unit comprising:

a first memory to store and provide consumable item information on a consumable used in forming images, and a second memory to rewrite recycling prevention information, which indicates when recycling is not allowed, a limited number of times; and a controller to extract the consumable item information and the recycling prevention information from the first memory and the second memory, respectively, and to control the use of the consumable, wherein the consumable item information stored in the first memory comprises verification information on whether the consumable is genuine, and a printed page count, a remaining toner level and exhaustion information for the consumable.

19. The apparatus according to claim 18, further comprising a display, wherein, if the remaining toner level reaches a set threshold, the controller writes information indicating that the amount of toner remaining is not sufficient as exhaustion information for the consumable, and directs that a message instructing a user to replace the consumable be displayed on the display.

20. An image forming apparatus comprising:

a plurality of consumable units, each providing a separate color toner used in forming images and each comprising a first memory to store and provide toner level information on the separate color toner used in forming images;

a second memory to rewrite recycling prevention information, which indicates when recycling is not allowed, a limited number of times; and a controller to extract the consumable item information and the recycling prevention information from the first memory and the second memory, respectively, of each of the consumable units and to control the use of the color toner of each of the consumable units, wherein the first memory is a secret memory that is coded and manufactured in order to prevent the first memory from being recycled in an image forming apparatus.

21. The image forming apparatus of claim 20, wherein the image forming apparatus comprises a consumable unit providing yellow toner, a consumable unit providing cyan toner, a consumable unit providing magenta toner and a consumable unit providing black toner.

* * * * *